US005169496A

United States Patent [19]

Wagle et al.

[11] Patent Number: 5,169,496

[45] Date of Patent: Dec. 8, 1992

[54] METHOD OF PRODUCING MULTI-PLY PAPER AND BOARD PRODUCTS EXHIBITING INCREASED STIFFNESS

[75] Inventors: Dinkar G. Wagle, Monroe; Vacheslav Yasnovsky, Nyack; Leo N. Nelli, Wallkill, all of N.Y.

[73] Assignee: International Paper Company, Tuxedo, N.Y.

[21] Appl. No.: 879,451

[22] Filed: May 1, 1992

Related U.S. Application Data

[63] Continuation of Ser. No. 689,992, Apr. 23, 1991, abandoned.

[51] Int. Cl.[5] ..... D21H 27/38

[52] U.S. Cl. ..... 162/129; 162/9; 162/125

[58] Field of Search ..... 162/9, 123, 129, 125

[56] References Cited

U.S. PATENT DOCUMENTS

| | | | |
|---|---|---|---|
| 2,098,733 | 11/1937 | Sale | 92/39 |
| 2,920,010 | 1/1960 | Volret | 162/76 |
| 3,013,934 | 12/1961 | Aitken et al. | 162/83 |
| 3,393,122 | 7/1968 | Marshall | 162/27 |
| 3,630,832 | 12/1971 | Ingruber et al. | 162/49 |
| 4,116,758 | 9/1978 | Ford et al. | 162/28 |
| 4,211,605 | 7/1980 | Saxton et al. | 162/64 |
| 4,431,479 | 2/1984 | Barbe et al. | 162/9 |
| 4,502,918 | 3/1985 | Mackie et al. | 162/24 |
| 4,913,773 | 4/1990 | Knudsen et al. | 162/129 |

FOREIGN PATENT DOCUMENTS 1071805 9/1980 Canada .

*Primary Examiner*—Peter Chin

*Attorney, Agent, or Firm*—Luedeka, Hodges, Neely & Graham

[57] ABSTRACT

The stiffness of multi-ply paper and board products is increased by dewatering the base ply on the papermaking machine to a consistency of at least about 8% prior to application of the next ply. The desired laminating consistency is more readily achieved through the use of pulp which has been subjected to a heat treatment process comprising heating the pulp at a temperature in the range of 170° C. to 250° in the presence of water for at least about 0.1 minutes, which reduces the water retention valve of the pulp. The heat treated pulp also produces a stiffer multi-ply product in its own right, which augments the stiffness advantage connected with attainment of higher laminating consistencies.

8 Claims, 1 Drawing Sheet

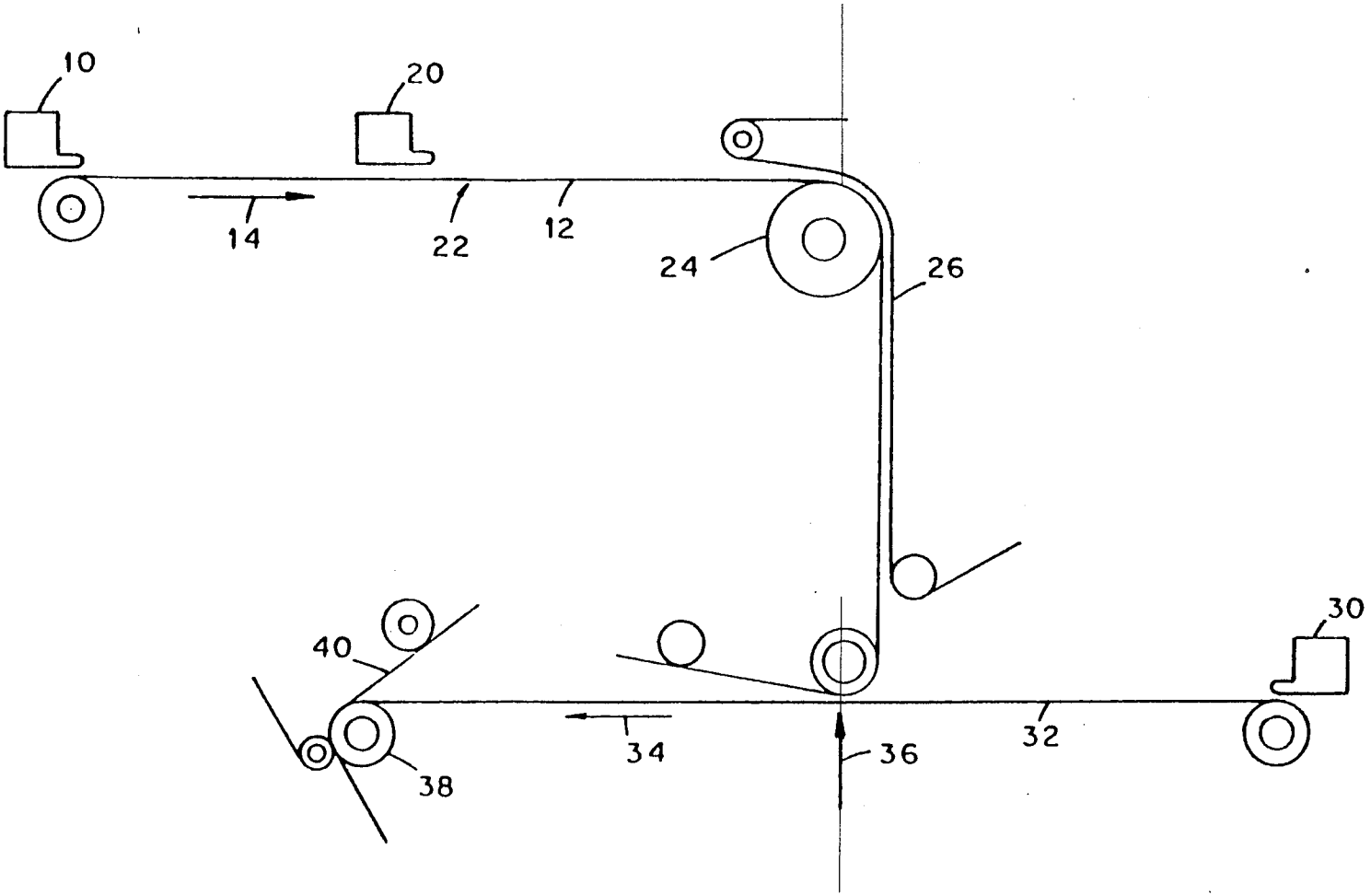
10
14
20
22
12
24
26
30
32
36
34
38
40

METHOD OF PRODUCING MULTI-PLY PAPER AND BOARD PRODUCTS EXHIBITING INCREASED STIFFNESS

This is a continuation of application Ser. No. 07/689,992, filed Apr. 23, 1991, now abandoned.

The invention generally relates to methods for making multi-ply paper and board products from cellulosic fibers and more particularly relates to a method for making multi-ply paper and board products which exhibit increased stiffness to enhance the usefulness of the products in various applications.

Stiffness is an important characteristic of certain grades of paper and board products such as, for example, products used to fabricate folding boxboard and liquid packages and cartons. Multi-layer or multi-ply paper and board products are generally stiffer than corresponding single ply products and have been widely used in the production of such articles. Generally speaking, it is considered an improvement to achieve increased stiffness in such products for a given basis weight without significantly adversely affecting other properties.

It is therefore an object of the present invention to provide a method for making multi-ply paper and board products.

Another object of the invention is to provide a method for making cellulosic fibrous pulp-based multi-ply paper and board products which exhibit increased stiffness.

A further object of the invention is to provide a method for producing a cellulosic fiber pulp which enables the manufacture of multi-ply products that exhibit increased stiffness.

An additional object of the invention is to provide a method for making multi-ply paper and board products which enables increased product yield for a given stiffness.

Yet another object of the invention is to provide a method for producing multi-ply paper and board products that are less subject to delamination.

A still further object of the invention is to provide a method for making multi-ply paper and board products incorporating a chemical pulp within at least one of the plies thereof wherein the resulting multi-ply product exhibits increased stiffness.

Still another object of the invention is to provide a method for making multi-ply paper and board products wherein the resulting products exhibit increased stiffness while other properties are not significantly adversely effected.

A further object to the invention is to provide a method for making multi-ply paper and board products which may be carried out using conventional paper and board manufacturing equipment and wherein the processing conditions are relatively mild and do not require elaborate or prolonged treatments in order to obtain the improved properties disclosed herein.

Another object of the invention is to provide a method for making multi-ply paper and board products which enables a more efficient mode of operation.

The invention relates to a method of making multi-ply paper and board products from cellulosic fibers which comprises providing first and second aqueous slurries of cellulose fibers each having a consistency below about 4%, depositing the first slurry of fibers in a layer on a foraminous support such as a moving fourdrinier wire, e.g., to provide a first layer of slurried fibers supported thereon, dewatering the first layer of slurried fibers to a laminating consistency of at least about 8% to provide a first forming ply of fibers on the support, depositing the second slurry of fibers on the first forming ply of fibers to provide a second layer of slurried fibers supported on the first forming ply of fibers, dewatering the second layer of slurried fibers to provide a second forming ply of fibers atop the first forming ply of fibers, and thereafter further dewatering the first and second forming plies of fibers to provide at least two plies of a multi-ply paper or board product having said first and second superposed dewatered fibrous plies interbonded along their interface.

The resulting multi-ply product exhibits an increased stiffness relative to corresponding multi-ply products produced by conventional methods and is considerably stiffer than single ply products of comparable basis weight and construction. This enables a yield advantage, i.e., a basis weight reduction for a given stiffness.

According to one aspect of the invention, at least a substantial portion of the fibers in the first slurry are subjected to a heat treatment prior to application to the wire to provide an even greater increase in the stiffness of the resulting multi-ply products. The treatment comprises heating the fibers (also referred to herein as the "pulp") in the presence of water at a temperature of from about 170° C. to about 250° C. for at least about 0.1 minutes. The stiffness/basis weight ratios of the products may be increased 30 percent by virtue of the incorporation of the heat treated pulp within at least one of the layers.

The heat treated pulp also retains less water so that the desired laminating consistency is more rapidly achieved on the wire. This enables an increase in the wire speed or a decrease in the distance between headboxes for a given desired laminating consistency. Or, for a given wire speed and headbox separation, the laminating consistency at the application of the subsequent ply will be increased through the use of the heat treated pulp which will further increase the stiffness of the product.

The heat treatment is preferably carried out after the pulp has been washed free of chemicals and residue associated with previous delignification or bleaching operations. The process may be carried out using conventional equipment available in most papermills such as a continuous or batch digester, or a heat exchanger, for example.

A preferred temperature range for the heat treatment is from about 200° C. to about 240° C. and the pH of the bath is preferably kept between about 5 and about 8 during the treatment. The heat treatment is carried out in the presence of water, typically using a pulp slurry, and the consistency is preferably maintained in the range of 3 to 40%. A preferred range for the duration of the heating of the pulp is from about 0.01 minutes to about 10 minutes. This may be achieved by flowing the pulp slurry through the treatment apparatus (e.g., a continuous pressurized digester) while heating the slurry to attain the necessary time/temperature relationship.

It is often necessary or desirable to refine the pulp before it is incorporated into a ply of the product. Refining has the advantage of further defibration of the material for improvement in certain properties. In carrying out the present invention, it is preferred that any refining of the pulp be carried out prior to the heat treatment. Refining after the heating of the pulp appears to negate the stiffness increase achieved thereby. Pulp that is unrefined prior to treatment and which is incorporated within the product without any refining appears to produce the greatest improvement in the product stiffness and fold endurance.

The heat treated pulp may be used to provide all or part of any layer of a multi-ply paper or board product produced of cellulosic fibers. Preferably, however, the heat treated fibers are employed to provide at least the lower (initial) or base layer in any such product.

Multi-ply products incorporating layers made up of the heat treated pulp of the invention also exhibit considerably decreased apparent densities. Density decreases in the order of 8 percent have been found with a corresponding increase in Taber stiffness of 30 percent.

The fold endurance of multi-ply products containing the heat treated pulp is substantially unaffected and remains relatively high while significant increases in stiffness/weight basis ratios are achieved. Conventional wisdom teaches that fold endurance and stiffness are generally inversely related in terms of their effect on one another. Accordingly, one would have expected that a stiffer product would exhibit a corresponding reduction in fold endurance but such is not the case with the multi-ply products of the present invention.

With reference to the accompanying drawing, the aspect of the invention related to the use of increased laminating consistency is illustrated with respect to one type of apparatus that may be employed in the process.

A pulp slurry or furnish for the production of an initial or base ply of fibers in a multi-ply product is contained in a first headbox 10 and the pulp preferably has been subjected to the aforedescribed heat treatment procedure. The furnish may desirably contain a mixture of heat treated kraft softwood and hardwood pulp. The proportion of softwood to hardwood may vary according to end use specifications, with a ratio of from between about 50/50 to about 20/80 softwood/hardwood being preferred for most applications. The headbox consistency, temperature and slice pressure may vary according to conventional practice.

The furnish slice sheet or jet from headbox 10 is received atop a fourdrinier wire 12 which is moving in the direction of arrow 14. The ratio of the jet velocity to the wire velocity at the point of contact is essentially unity, although a slightly greater jet velocity may enhance floc uniformity in some applications. The fourdrinier wire is a foraminous support that is configured to promote the formation of a web or ply of fibers by maintaining a substantially planer, uniform thickness of the furnish as the water drains from the fibers. Drainage is accelerated by the use of various drainage elements located closely adjacent the underside of the wire and this enables the attainment of a relatively high speed of the wire for a given distance of separation between the first headbox 10 and a second headbox 20, which contains a second or subsequent furnish that is used to provide a second ply atop the first ply forming on the wire 12.

The furnish within the second headbox 20 may contain the same or a different pulp mixture as is contained in the first headbox 10 depending on end use specifications. Thus, in one embodiment the pulp within the second furnish is subjected to the heat treatment process described herein to provide a more rapidly draining pulp that produces a stiffer ply. In the case of a multi-ply product containing three plies as is produced according to the arrangement in the depicted apparatus, the slice jet from the second headbox 20 forms the middle ply of the product and is preferably configured so that approximately 50% of the basis weight of the product is contained within the region of the middle ply. The location at which the slice jet from the second headbox 20 contacts the first forming ply on the wire 12 is referred to herein as the laminating point and is indicated at 22.

According to one feature of the invention, the consistency of the first forming ply on the wire 12 at the laminating point 22 or the "laminating consistency" of the first forming ply is maintained at about or above 8% to enable the production of multi-ply products exhibiting improved stiffness. The use of higher laminating consistencies is believed to result in an increased stiffness by permitting a higher degree of web consolidation of the upper surface of the first forming ply prior to application of the jet from the headbox containing the fiber slurry for the next ply. This is believed to result in less intermingling of the fibers and fiber constituents during formation of the respective plies so that the effectiveness of the contributions of the discrete plies to stiffness are enhanced.

The attainment of the desired laminating consistency of the first forming ply on the wire is accelerated by the use of heat treated pulp as a substantial component of the pulp of the furnish in headbox 10. The heat treated pulp retains less water, which enables an increase in the effective drainage rate so that a relatively high consistency is achieved earlier as water drains through the wire. This enables a shortening of the wire section between the headboxes 10 and 20 or an increase in the speed of the wire, which improves the cost efficiency of the process. The use of heat treated fibers in the first forming ply has a further advantage in that the fibers themselves produce a stiffer ply, so that the use of the heat treated pulp multiplies the stiffness improvement resulting from the use of high laminating consistencies.

After lamination of the second or middle ply from headbox 20, the two superposed forming plies pass over a perforated turning roll 24 between the wire 12 and a backing wire 26 where the forming plies are further dewatered to about 10 to 12% solids.

A third headbox 30 contains a furnish for providing the third or top ply of the multi-ply product and may contain a pulp mixture that is the same or different from the furnish in headboxes 10 and 20. Again, it is preferred that the pulp for the furnish in the third headbox 30 be subjected to the aforedescribed heat treatment to provide a more rapidly draining pulp that produces a stiffer ply. Typically, the slice jet dimension from headbox 30 and the consistency of the pulp contained therein is such that the basis weight contribution of the plies formed from the furnish in headboxes 10 and 30 is about the same. The slice jet from headbox 30 is received onto a second fourdrinier wire 32 which is moving in the direction of arrow 34. The two plies on wire 12 are laminated to the third or upper forming ply on wire 32 at a laminating point indicated at 36 where the consistency of the third forming ply is from about 3 to about 4% solids. After lamination, the three forming plies pass over a couch roll 38 with the assistance of a backing wire 40. The three ply structure is then nipped and reeled at a consistency in the neighborhood of 40% solids.

The following examples will further illustrate various aspects of the invention. Unless otherwise indicated, all temperatures are in degrees Celsius and all percentages are by weight.

EXAMPLE 1

A series of triple-ply boards were prepared in which the characteristics of the pulp used in the middle ply were varied. Bleached kraft hardwood and softwood pulps were used to form the three plies in all of the tests. For certain samples, the pulp for use in the middle ply was subjected to a heat treatment which was carried out by heating the pulp in a laboratory digester at a temperature of about 200° C. for about 2 minutes at a pulp consistency in the neighborhood of 3½ to 4%. Board hand sheets at 215 pounds per 3000 square feet were made on a laboratory multi-ply forming apparatus sold under the trademark Formette Dynamique by Centele Technique of Dupapire Grenoble, France. The variables in the middle ply are summarized as follows:

Test No. 1—3 ply control—pulp as received from the mill

Test No. 2—positive control containing 50 percent CTMP at 300 CSF in the middle ply Test No. 3—heat treatment of unrefined pulp Test No. 4—pulp refined to 610 CSF before heat treatment Test No. 5—pulp refined to 610 CSF after heat treatment The details of the furnish variations are provided below in Table 1.

TABLE 1

MECHANICS OF MULTI-PLY CONSTRUCTION

| | Test 1 | Test 2 | Test 3 | Test 4 | Test 5 |
|---|---|---|---|---|---|
| Number of Samples: | 8 | 10 | 10 | 10 | 6 |
| Top Ply Construction | | | | | |
| Percent Ply Height: | 25 | 25 | 25 | 25 | 25 |
| Percent Softwood: | 75 | 75 | 75 | 75 | 75 |
| Softwood Freeness: | 550 | 550 | 550 | 550 | 550 |
| Percent Hardwood: | 25 | 25 | 25 | 25 | 25 |
| Hardwood Freeness: | 550 | 550 | 550 | 550 | 550 |
| Middle Ply Construction | | | | | |
| Percent Ply Height: | 50 | 50 | 50 | 50 | 50 |
| Percent Softwood: | 10 | 25 | 10 | 10 | 10 |
| Softwood Freeness: | 740 | 610 | 740 | 610 | 610 |
| Percent Hardwood: | 90 | 25 | 90 | 90 | 90 |
| Hardwood Freeness: | 660 | 610 | 660 | 620 | 620 |
| Bottom Ply Construction | | | | | |
| Percent Ply Height: | 25 | 25 | 25 | 25 | 25 |
| Percent Softwood: | 75 | 75 | 75 | 75 | 75 |
| Softwood Freeness: | 550 | 550 | 550 | 550 | 550 |
| Percent Hardwood: | 25 | 25 | 25 | 25 | 25 |
| Hardwood Freeness: | 550 | 550 | 550 | 550 | 550 |

TABLE 1-MECHANICS OF MULTI-PLY CONSTRUCTION

The board properties are shown below in Table 2.

TABLE 2

EFFECT OF HEAT TREATMENT OF PULP IN CENTER PLY

| | Test 1 | Test 2 | Test 3 | Test 4 | Test 5 |
|---|---|---|---|---|---|
| Basis Weight (lbs/3000 sq ft) | 255.1 | 217.8 | 214.8 | 219.9 | 219.2 |
| Caliper (mils) | 21.0 | 20.6 | 21.6 | 20.7 | 20.7 |
| Density (grams/cc) | 0.444 | 0.437 | 0.411 | 0.440 | 0.437 |
| Breaking Length | 5.0 | 5.6 | 4.9 | 4.9 | 5.4 |

TABLE 2-continued

EFFECT OF HEAT TREATMENT OF PULP IN CENTER PLY

| | Test 1 | Test 2 | Test 3 | Test 4 | Test 5 |
|---|---|---|---|---|---|
| (kilometers) | | | | | |
| Taber Stiffness | 267.7 | 294.1 | 333.5 | 301.5 | 255.9 |
| (grams × cm) | 1.19 | 1.35 | 1.55 | 1.37 | 1.17 |
| Fold Endurance (folds × 65/B.W.) | 308 | 244 | 405 | 318 | 315 |

The test results show an increase in the stiffness/basis weight ratio of 30 percent over the control (Test 1) by the use of heat treated unrefined pump in the middle plies (Test 3). The density value is the lowest for the test with the highest stiffness/basis weight ratio. The fold endurance value is the highest for the unrefined heat treated sample (Test 3). Overall, the test results show that the heat treatment process on unrefined kraft pump for use in the middle ply of a multi-ply constructed board results in a substantially increase in Taber stiffness without any significant deleterious effects on other board properties.

EXAMPLE 2

Unbeaten bleached kraft pulp sheets were tested for water retention before and after a heat treatment which consisted of heating the pulps in a laboratory digester at a consistency of about 3½% to 4% and a temperature of 240° C. for 60 seconds. The results are shown in Table 3.

TABLE 3

WATER RETENTION VALUE (WRV) ($gH_2O/g$ pulp) FOR HEAT TREATED PULPS

| Pulp | Pre-Treatment WRV | Post-Treatment WRV |
|---|---|---|
| Softwood paper-grade | 1.25 | 0.92 |
| Hardwood paper-grade | 1.62 | 1.18 |
| Hardwood dissolving-grade (Aceta Kraft ®) | 1.42 | 1.23 |

Similar drops in WRV were observed for an unbleached linerboard pulp where the pulp was subjected to a temperature of 200° C. at a consistency of about 3½% to 4%. Prior to treatment, the pulp had a WRV of about 1.28. After about 20 seconds, the WRV dropped to about 1.22. After about 1 minute, the WRV dropped to about 1.19. After about 5 minutes, the WRV was down to about 1.025. And after about 15 minutes, the WRV had dropped to about 1.01.

EXAMPLE 3

The apparatus and process described above with respect to the drawing was used to produce multi-ply board products. The furnish in all headboxes 10, 20 and 30 was a kraft pulp consisting of 20% pine/80% hardwood and the basis weight distribution was 25% in each of the base and upper plies and 50% in the middle ply. For comparison, a single ply product was produced from headbox 30 with a 50/50 mixture of hardwood/-softwood. Otherwise, the conditions for formation of the single ply product were kept approximately the same so that a direct comparison could be made so as to the resulting board properties. For the multi-ply product, the consistency of the first forming ply on wire 12 at the laminating point 22 was varied with basis weight and the results are shown below in Tables 4–6.

TABLE 4

EFFECT OF LAMINATING CONSISTENCY FOR RELATIVELY HIGH BASIS WEIGHTS

| Laminating Consistency, % | Basis Wt., lb./1000 ft$^2$ | Caliper 0.001 in. | Stiffness, g-cm for MD/CD (MD/CD) |
|---|---|---|---|
| 3.5 | 202 | 24.4 | 232/177(203) |
| 8.8 | 200 | 24.1 | 233/172(200) |
| 9.4 | 199 | 24.3 | 258/178(214) |
| single ply | 202 | 24 | 202/143(170) |

TABLE 5

EFFECT OF LAMINATING CONSISTENCY FOR MIDDLE RANGE BASIS WEIGHTS

| Laminating Consistency, % | Basis Wt., lb./1000 ft$^2$ | Caliper 0.001 in. | Stiffness, g-cm for MD/CD (MD/CD) |
|---|---|---|---|
| 3.7 | 170 | 20.3 | 144/96(118) |
| 9.7 | 181 | 22.2 | 188/132(158) |
| 9.9 | 181 | 23.1 | 197/141(167) |
| single ply | 182 | 21.5 | 164/116(138) |

TABLE 6

EFFECT OF LAMINATING CONSISTENCY FOR RELATIVELY LOW BASIS WEIGHTS

| Laminating Consistency, % | Basis Wt., lb./1000 ft$^2$ | Caliper 0.001 in. | Stiffness, g-cm for MD/CD (MD/CD) |
|---|---|---|---|
| 3.3 | 144 | 17.2 | 93/67(79) |
| 9.0 | 146 | 17.4 | 109/73(89) |
| 8.8 | 130 | 15.6 | 81/55(67) |
| 9.7 | 149 | 18.2 | 125/86(104) |
| single ply | 147 | 17.6 | 97/62(77) |

The data show that an increase in laminating consistency from the 3.3% to 3.7% range to the 8.8% to 9.9% range resulted in an increase in stiffness over the entire basis weight range. Also, the yield advantage in terms of stiffness as compared to the single-ply board was in the range of 7% to 10% and the yield advantage does not drop appreciably with decreasing basis weight for the multi-ply product at the higher laminating consistency. This is contrasted with the relatively lower laminating consistencies which exhibit a decrease in yield advantage over single ply with decreasing basis weight. In addition, the yield advantage appears to generally increase with increasing laminating consistency over the ranges of these tests.

Although several embodiments of the invention have been described in the foregoing detailed description, it will be understood that the invention in practice is capable of numerous modifications, additions, and rearrangements without departing from the scope and spirit of the appended claims.

We claim:

1. A process for making a multi-ply paper or board product having two or more superposed plies formed of cellulosic fibers which comprises:

depositing a first furnish of fibers on a moving foraminous support to provide a first layer of slurried fibers on the support;

progressively dewatering the first layer to provide a first forming ply of fibers on the support;

heating fibers to be used in the formation of at least one ply of the product at a temperature of from above about 170° C. to about 250° C. in the presence of water for at least about 0.1 minutes;

incorporating the heat treated fibers in a second furnish of fibers for providing at least a portion of at least one ply of the product;

depositing the second furnish of fibers atop the first forming ply to provide a second layer of slurried fibers containing the heat treated fibers on the support atop the first forming ply; and progressively dewatering the second layer through the first forming ply to provide a second forming ply containing heat treated fibers atop of the first forming ply and, thereafter, further dewatering the plies to provide a multi-ply product having superposed dewatered fibrous plies interbonded along their interface wherein the product exhibits increased stiffness for a given basis weight as compared to a multi-ply product wherein the plies do not contain the heat treated fibers.

2. The process of claim 1, further comprising dewatering the first forming ply to a laminating consistency of at least about 8% at the point at which the second furnish is deposited thereon.

3. The process of claim 1, further comprising depositing a third furnish of fibers atop the second forming ply.

4. The process of claim 3, further comprising dewatering the second forming ply to a laminating consistency of at least about 8% at the point at which the third furnish is deposited thereon.

5. The process of claim 1, wherein the heat treated fibers are substantially unrefined whereby the resulting multi-ply produce exhibits increased fold endurance.

6. The process of claim 1, wherein the fibers are heated at a temperature in the range of about 200° C. to about 240° C.

7. The process of claim 1, wherein the fibers subjected to the heat treatment are chemical pulp.

8. The process of claim 1, wherein the heat treated fibers are incorporated within the first furnish to provide at least a portion of the first forming peg.

* * * * *

UNITED STATES PATENT AND TRADEMARK OFFICE

CERTIFICATE OF CORRECTION

PATENT NO. : 5,169,496

DATED : December 8, 1992

INVENTOR(S) : Dinkar G. Wagle, Vacheslav Yasnovsky and Leo M. Nelli

It is certified that error appears in the above-identified patent and that said Letters Patent is hereby corrected as shown below:

On the title page, Item [75] Inventors:

After the name of "Inventors" at the heading information on the patent, the inventor identified as "Leo N. Nelli" should be --Leo M. Nelli--.

In the abstract, at line 8, after "250°", insert --C--

In the abstract, at line 10, "valve" should be "value".

Column 2, line 57, "0.01" should be --0.1--.

Column 5, lines 55-56, delete the heading "TABLE 1-MECHANICS OF MULTI-PLY CONSTRUCTION".

Column 6, line 18, "pump" should be --pulp--.

Column 6, line 20, "substantially" should be --substantial--.

Signed and Sealed this

Seventh Day of December, 1993

*Attest:*

*Attesting Officer*

Bruce Lehman

BRUCE LEHMAN

*Commissioner of Patents and Trademarks*